United States Patent [19]

Drabert et al.

[11] 4,411,469

[45] Oct. 25, 1983

[54] CHAIR, PARTICULARLY A DATA DISPLAY CHAIR

[75] Inventors: Fritz Drabert, Minden, Fed. Rep. of Germany; Oskar Posch, Biberist, Switzerland; Hans-Joachim Edel, Minden; Bernhard Schroeder, Porta Westfalica, both of Fed. Rep. of Germany

[73] Assignee: Drabert Söhne, Minden, Fed. Rep. of Germany

[21] Appl. No.: 169,615

[22] Filed: Jul. 17, 1980

[30] Foreign Application Priority Data

| | | | |
|---|---|---|---|
| Jul. 23, 1979 | [CH] | Switzerland | 6826/79 |
| Jan. 31, 1980 | [CH] | Switzerland | 787/80 |
| Mar. 31, 1980 | [CH] | Switzerland | 2503/80 |
| May 19, 1980 | [CH] | Switzerland | 3892/80 |

[51] Int. Cl.[3] ..... A47C 3/00

[52] U.S. Cl. ..... 297/300; 297/321; 297/322

[58] Field of Search ..... 297/300, 301, 304, 305, 297/322, 321

[56] References Cited

U.S. PATENT DOCUMENTS

| | | | |
|---|---|---|---|
| 343,654 | 6/1886 | Wilt | 297/321 |
| 786,326 | 4/1905 | Travers | 297/304 |
| 2,321,385 | 6/1943 | Herold | 297/301 |
| 2,859,801 | 11/1958 | Moore | 297/322 |
| 3,095,415 | 6/1963 | Schliephacke | 297/321 X |
| 3,128,122 | 4/1964 | Mizelle | 297/322 X |
| 3,337,267 | 8/1967 | Rogers, Jr. | 297/321 X |
| 3,989,297 | 11/1976 | Kerstholt | 297/300 |
| 4,143,910 | 3/1979 | Geffers et al. | 297/301 |

FOREIGN PATENT DOCUMENTS

| | | | |
|---|---|---|---|
| 2757652 | 6/1979 | Fed. Rep. of Germany | 297/322 |

*Primary Examiner*—Francis K. Zugel

[57] ABSTRACT

A chair having a base, a seat, a backrest and a spring between the seat and the backrest. A first pair of links is pivotably connected to the seat and the backrest respectively and a second pair of links is pivotably connected to the seat and the base respectively, one pair forming an angle lever connected to the seat. One end of the spring is adjustably supported either by a nut and spindle and a bar between the angle lever and the spring or by a slide in the form of a nut on a threaded spindle and a guide slidably receiving the slide and arranged in the angle lever.

3 Claims, 8 Drawing Figures

CHAIR, PARTICULARLY A DATA DISPLAY CHAIR

BACKGROUND OF THE INVENTION

The invention relates to a chair, particularly a data display chair having a pedestal or base, a seat part pivotally supported on the latter and a back rest pivotable about a transverse axis and connected to the seat part, while the seat part and the back rest are kinematically coupled together by means of a spring member.

Various constructions of chairs are known; whose support structure has appropriate components for meeting ergonomic demands. They are generally a compromise between these requirements, the manufacturing expenditure, and subjective evaluation criteria.

Known chairs which are used as working chairs for personnel operating and using data displays fulfil certain economic requirements obviating sitting faults in the working posture, but they are not able to fulfil additional ergonomic or bio-technical requirements, such are encountered when working with data displays. For example, generally considerable time and skill is required to match the body weight of the person using the chair to the strength of the spring forces forming the counterforce for the user's body weight, as well as for re-straightening the chair back. In addition, the requirements concerning the operation of electronic office equipment are virtually unknown and their ergonomic significance has hitherto hardly been taken into consideration by chair manufacturers.

BRIEF SUMMARY OF THE INVENTION

The problem underlying the present invention is to so develop a chair of the type referred to hereinbefore that it permits a balanced body posture, particularly in three sitting positions, namely the upright, normal (working posture), the relaxed sitting position or "relaxed posture", and the special "leaning forward gripping posture", as well as in other sitting positions. Thus, the complete muscular system of the chair user is to be relieved to the optimum extent, the intervertebral disc pressure is to be reduced and venous congestion in the legs and pelvic cavity is to be avoided. In addition, to achieve maximum comfort, there should be no movement of clothing in the back part on passing into the relaxed posture.

According to the invention, this problem is solved in that, by means of seat part-side swivel joints, first linkages are mounted on the back rest side of a seat frame of the seat part and at the other end thereof are connected by means of swivel joints to a back rest bracket of the back rest.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
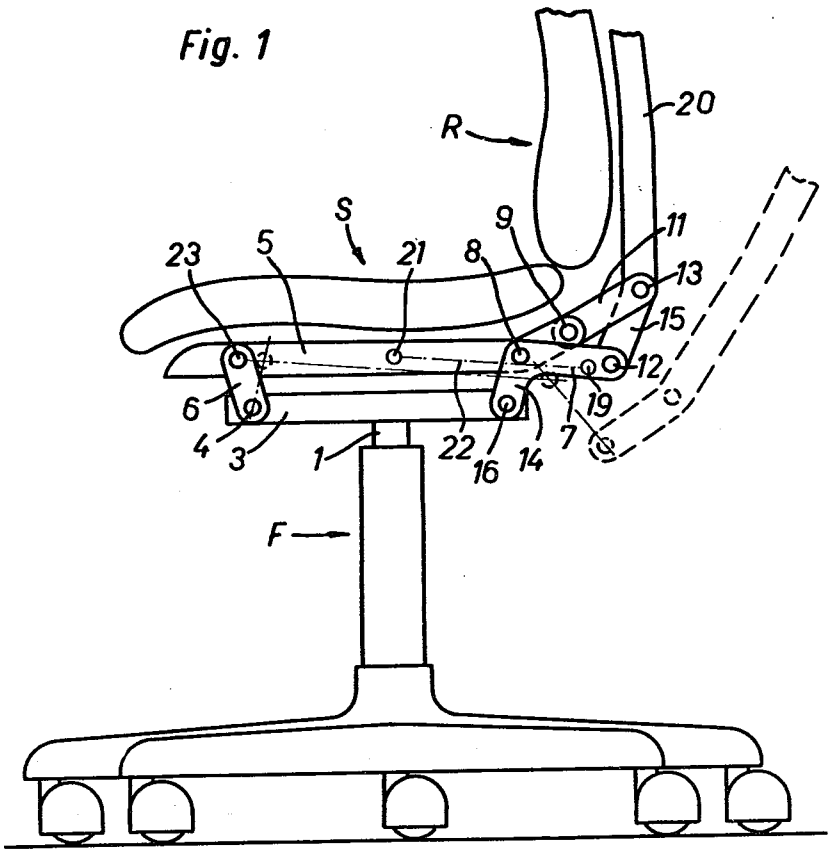
FIG. 1 is a side view, partly in section, of a diagrammatically represented chair according to the invention.

The chair shown in FIG. 1 has a pedestal or base F with a column 1 indicating by broken lines, a seat part S and a back rest R connected to the seat part S. The chair support structure comprising supporting members for the seat part S and the back rest R is shown in the kinematic equivalent-circuit diagrams of FIGS. 2 to 4 for a first embodiment. A plate-like crosspiece 3 on which is pivotably mounted a seat frame 5 is located at the upper end of column 1, which can be moved up and down for adjusting the seat height and then fixed. The crosspiece 3 and seat frame 5 are connected by linkages 6, 14 forming linkage pairs, whereof one end is connected by means of swivel joints 4, 16 to crosspiece 3 and the other end is connected via swivel joints 8, 23 with seat frame 5. By supporting the seat frame 5 on crosspiece 3 by means of the movable linkages 6, 14, it is possible to raise or lower seat frame 5, and thereby seat part S, both on the back rests side and on the knee side.

The support structure also has a back rest bracket 20 forming part of back rest R and which is articulated, by means of two linkages 7, 11 forming a linkage pair to the back rest-side portion of seat frame 5 by means of swivel joints 8,9, whereby one linkage 7 is connected by swivel joint 12 and the other linkage 11 by swivel joint 13, to the back rest bracket 20. The linkage pair comprising linkages 7, 11 constitutes a kinematic gear. The distances between the ends of linkages 7, 11 both on seat frame 5 and on the back rest bracket 20 remain constant during all movements of the support structure, and the lower end of the bracket 20 constitutes a coupler 15 between swivel joints 12, 13.

Figure 2:
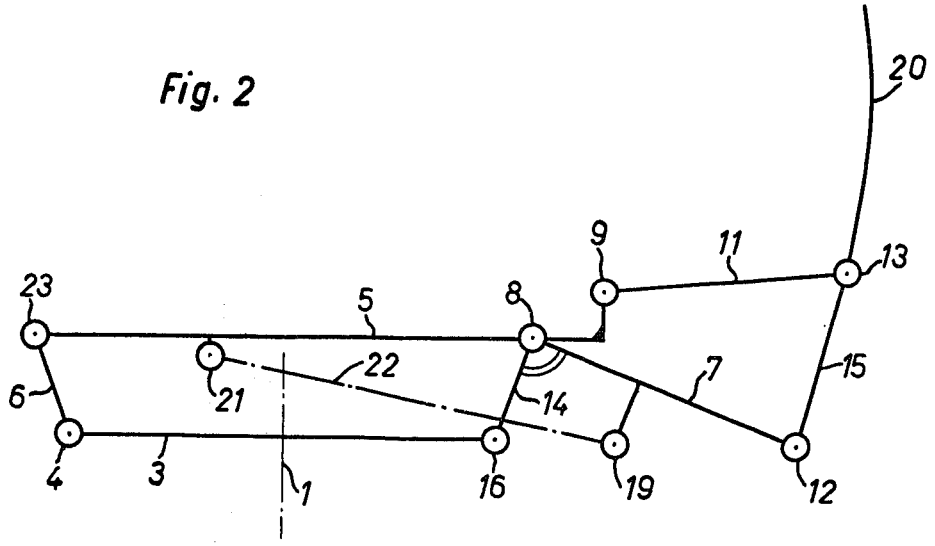
FIGS. 2 to 4 are kinematic equivalent-circuit diagrams of the support structure of the chair according to FIG. 1, in the working posture (FIG. 2), the relaxed posture (FIG. 3), and the leaning forward gripping posture (FIG. 4)
Figure 3:
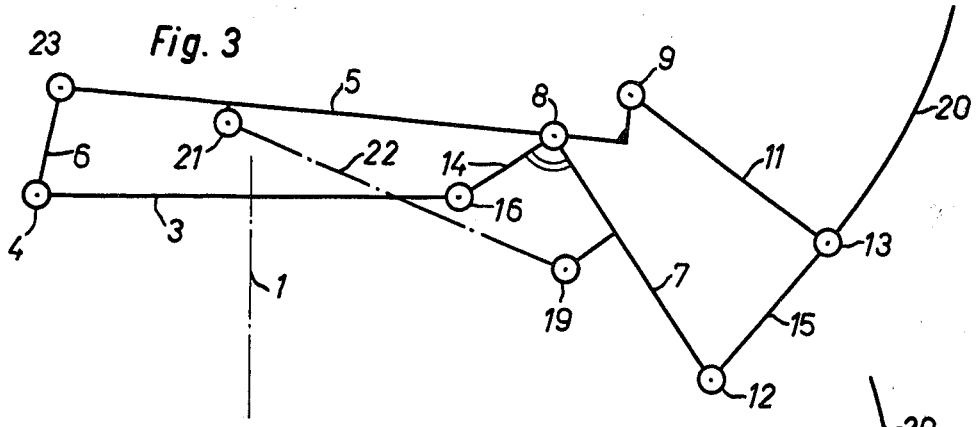
Figure 4:
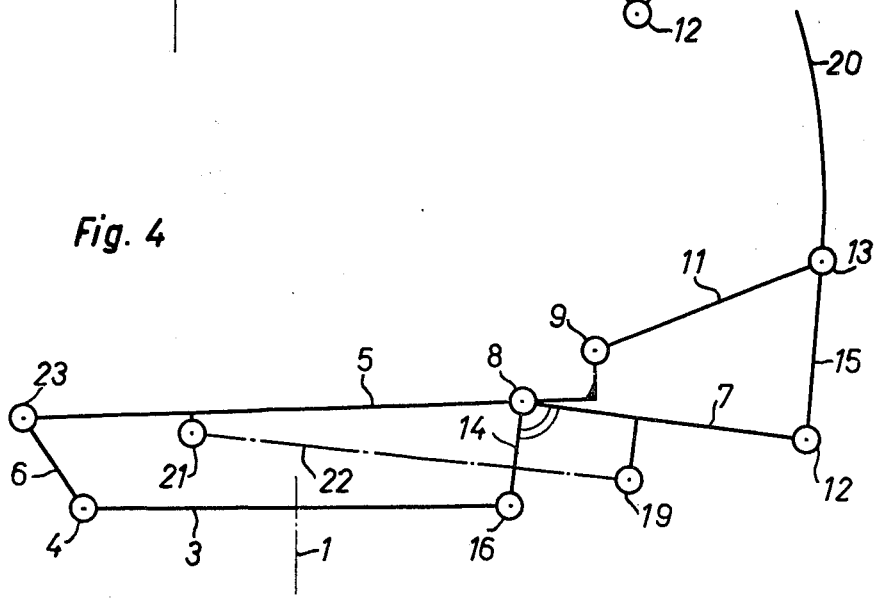

The reference numerals used in FIGS. 2 to 4 are the same as in FIG. 1. Linkages 7 and 14 are combined into a bent angle lever mounted in the swivel joint 8 forming one connection of the back rest bracket 20 to crosspiece 3, while the other connection is formed by the linkage 11, seat frame 5 and linkage 6.

The bent angle lever 7, 14 can advantageously be constructed as a linkage plate and has a swivel joint 19 on which is supported one end of a spring member 22, e.g. a gas pressure spring shown by dotted lines and at the other end thereof it is supported on seat frame 5 by means of a swivel joint 21.

The support structure position corresponding to the working posture shown in FIG. 2 indicates that the slightly curved back rest bracket forms a relatively large angle relative to the horizontal, e.g. 70° to 80°. In the support structure position corresponding to the relaxed posture shown in FIG. 3, linkages 7, 11 are moved somewhat downwards and the back rest bracket 20 assumes a relatively small angle relative to the horizontal, e.g. approximately 30° to 50°. At the same time, the distance between the swivel joints 19, 21 is reduced, so that spring member 22 exercizes a correspondingly modified pressure on back rest R.

In the support structure position corresponding to the leaning forward gripping posture shown in FIG. 4, the back rest bracket 20 is approximately perpendicular to the horizontal or is inclined slightly forwards. In this position, seat part S is displaced towards the data display (not shown) and swivel joint 23 and therefore seat frame 5 are lowered on the knee side, e.g. by at least 20 mm corresponding to an inclination of 45°. In the support structure positions corresponding to the working and relaxed postures, as the linkage 6 is in the vicinity of the apex of its movement, swivel joint 23 and therefore seat frame 5 are somewhat higher than in the leaning forward gripping posture. Linkage 14 changes its position correspondingly. During a continuous passage from the normal working posture to the leaning forward gripping posture, the back rest 20 follows the upper part of the chair user's body and seat frame 5 is raised rearwards because linkage 14 is in the vicinity of the apex of its movement (FIG. 4) and is lowered on the knee side because linkage 6 has clearly passed beyond its movement apex. On a continuous passage from the working posture into the relaxed posture the chair user's clothing is not displaced despite the back rest-side lowering of seat frame 5, due to linkages 7, 11.

Figure 5:
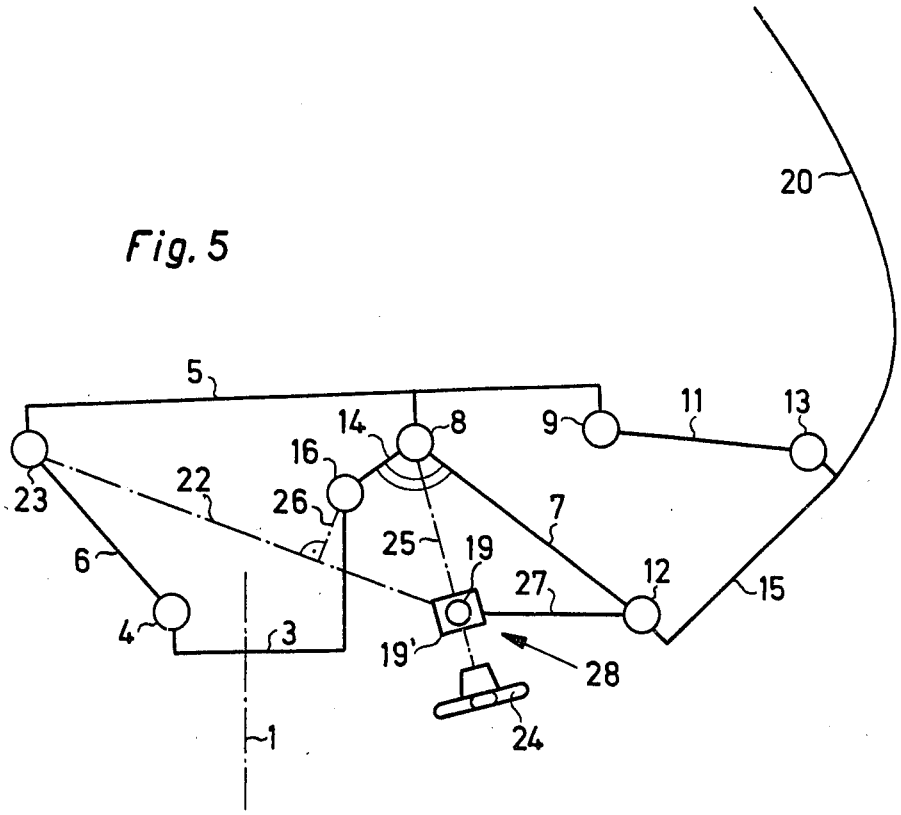
FIGS. 5 and 6 are kinematic equivalent-circuit diagrams of a first variant of the support structure of the chair of FIG. 1, in the leaning forward gripping posture (FIG. 5), and in the relaxed posture (FIG. 6)
Figure 6:
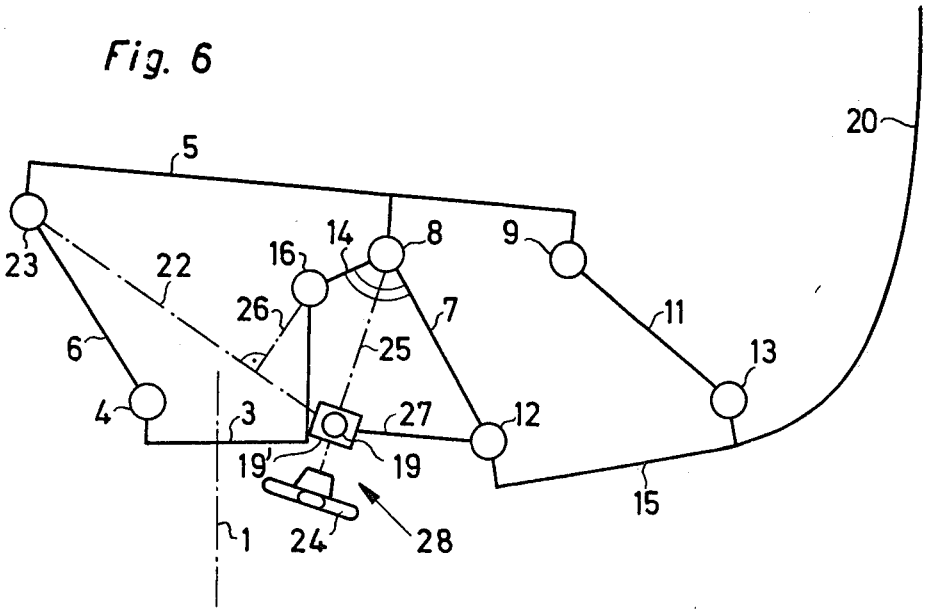

In the case of the support structure of FIGS. 5 and 6, where the reference numerals are the same as in FIGS. 2 to 4, an adjustable support 28 is mounted on the bent levers 7, 14 and as a result, the back rest-side end of spring member 22 is supported on the back rest bracket 20 or on the coupler 15 thereof.

Support 28 comprises a pivotably mounted threaded spindle 25 on which is arranged a spindle nut 19' and which is rotatable by a control grip 24. One end of spring member 22 is mounted in a swivel joint 19 placed in the spindle nut 19'. Swivel joint 19 serves to support one end of a bar 27, whose other end is mounted in the back rest-side swivel joint 12. Thus, the force of spring member 22 acts via the swivel joint 19 on spindle nut 19' and bar 27, on the back rest bracket 20. The essential lever arm is indicated by a broken line 26 perpendicular to the axis of spring member 22. If now the position of spindle nut 19' is changed by rotating control grip 24, the effective lever arm and therefore the force acting on the back rest bracket 20 is modified. It is advantageous to arrange the spring member 22 and bar 27 or the position of swivel joint 19 in such a way that the resultant of the compressive force of spring member 22 and the opposing force to be provided by bar 27 is maintained at a minimum and requires no exertion-necessitating operation of grip 24. If the position of swivel joint 19 in a central position is selected in such a way that bar 27 is aligned with spring member 22, there is a considerable modification to the effective lever arm 26 by a few turns of control grip 24.

FIG. 6 shows that on passing into the relaxed posture, the length of spring member is reduced. However, the aligned position of spring member 22 and bar 27 is substantially maintained, so that the resultant force acting on control grip 24 is small and even in this position an adjustment by grip 24 is possible.

In order that this favorable arrangement of support 28 can be achieved, it is advantageous to provide for different height positions of the pedestal-side swivel joints 4, 16, e.g. with joint 16 higher, and to position joints 4,16 in the vicinity of the axis of pedestal column 1. A simplification is also obtained if the seat part-side swivel joints 8,9,23 are aligned or at least approximately aligned. The swivelling range of the chair can easily be maintained if linkage 6 between swivel joints 4, 23 is made at least twice as long as linkage 14 of the bent lever 7, 14.

Figure 7:
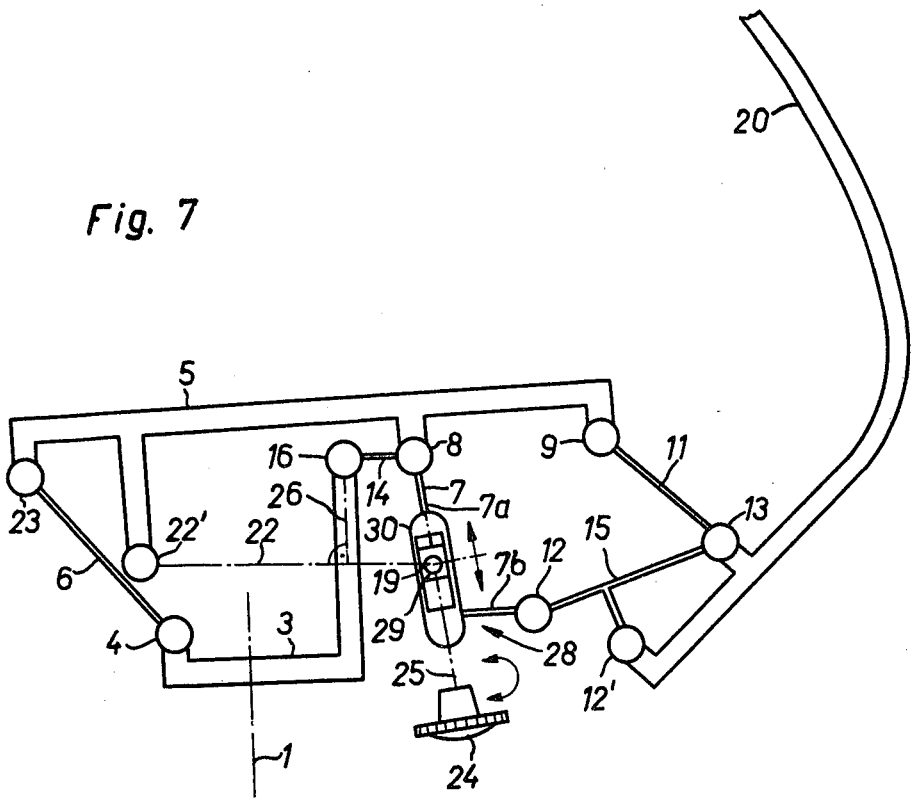
FIGS. 7 and 8 are kinematic equivalent-circuit diagrams of a second and third variant of the support structure of the chair of FIG. 1, in the leaning forward gripping posture.
Figure 8:
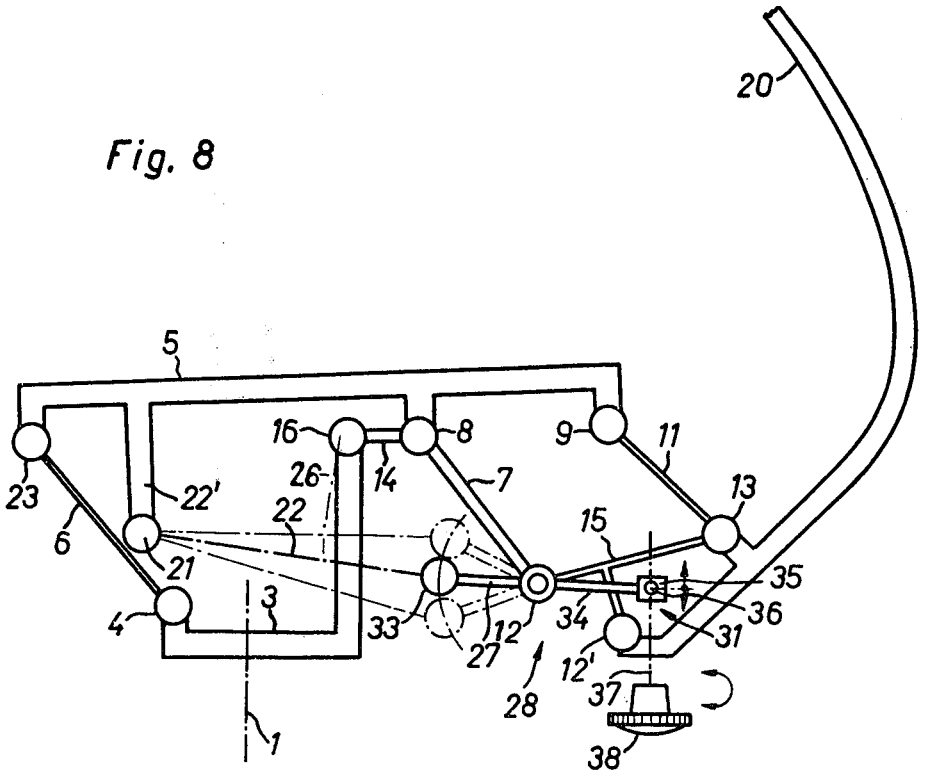

In the embodiment of the support structure shown in FIGS. 7 and 8, the adjustable support 28 is modified compared with that of FIGS. 5 and 6. However, once again, it is possible to easily adapt the chair to the particular user.

In FIG. 7, the knee-side end of spring member 22 with its swivel joint 21, is supported on a strut 22', while the other end is mounted in the adjustable support 28. Support 28 comprises the pivotably mounted threaded spindle 25, rotatable by control grip 24, and on which is arranged a slide 29 in the form of a spindle nut. One end of the spring member 22 is mounted by means of swivel joint 19 in slide 29, the latter being displaceably mounted in a guide 30 forming part of linkage 7. As is apparent from FIG. 7, link 7 of bent angle lever 7, 14 is itself constructed as a bent angel lever, whereof one lever arm 7*a* is substantially formed by guide 30 and is mounted in swivel joint 8, while the other lever arm 7*b* is mounted on the back rest-side swivel joint 12, which is in turn supported in the coupler 15 of back rest bracket 20. This arrangement renders superfluous the bar 27 of FIGS. 5 and 6. The modification of the vertical spacing 26 of joint 8 relative to the line of action of spring member 22 is performed in the same way by turning the control grip 24.

In FIG. 8, one end of spring member 22 is connected via a swivel joint 33 directly to the bar 27 supported on coupler 15 by means of swivel joint 12, while the other end of spring member 22 is supported on strut 22' by its swivel joint 21, as in FIG. 7. The support 28 mounted on coupler 15 or back rest bracket 20 has a double lever 27, 34 formed by the bar 27 and an adjusting arm 34. At the free end of adjusting arm 34 is provided an adjusting device 31, e.g. a worm drive, whose spindle nut 36 is mounted in a swivel joint 35 and is displaceable by a spindle 37 rotatable by a control grip 38. As a result, the position of swivel joint 33 and therefore lever arm 26 can be modified. By selection of the lengths of bar 27 and adjusting arm 34, it is also possible to carry out an exertion-free chair adjustment.

In the embodiments according to FIGS. 2 to 8, it is possible to continuously vary the length of the effective lever arm 26, on which spring member 22 acts by rotating the control grip 24 (or 38 in FIG. 8). As a result, the kinematics which fully automatically adapts the position and inclination of the seat surface to the position and inclination of the back rest are ergonomically correctly matched to the activity to be performed by the chair user. By increasing the effective lever arm 26, the chair is adapted also to a user with a greater body weight, whereas on reducing the lever arm 26 there is adaptation to a smaller body weight. The adjustment of control grip 24 (38) can be performed by the user without exertion when sitting, because the grip 24 (38) is within easy reach and as a result the user does not have to get up from the chair, take up a tool or even remove the upholstery from the back rest.

We claim:

1. A chair comprising: base means, seat means pivotally supported at said base means; back rest means pivotable with respect to said seat means about a substantially horizontal axis, spring means kinematically coupling said seat means and said back rest means, a first pair of links having first ends pivotally connected to said seat means and second ends pivotally connected to said back rest means, a second pair of links having first ends pivotally connected to said seat means and second ends pivotally connected to said base means, one of said pairs of links forming an angle lever pivotally connected at said seat means, said angle lever provided with means for adjustably supporting one end of said spring means, said means for adjustably supporting said spring means comprises a nut journaled on a threaded spindle, said nut supporting a pivot supporting one end of said spring means, and a bar having one end pivotally supported at said pivot and the other end pivotally supported as said angle lever.

2. A chair comprising: base means, seat means pivotally supported at said base means; back rest means pivotable with respect to said seat means about a substantially horizontal axis, spring means kinematically coupling said seat means and said back rest means, a first pair of links having first ends pivotally connected to said seat means and second ends pivotally connected to said back rest means, a second pair of links having first ends pivotally connected to said seat means and second ends pivotally connected to said base means, one of said pairs of links forming an angle lever pivotally connected at said seat means, said angle lever provided with means for adjustably supporting one end of said spring means, said supporting means is a slide in the form of a nut journaled on a threaded spindle, and a guide slidably receiving said slide and arranged in said one link of said angle lever.

3. A chair according to claim 2 wherein said one link of said angle lever forms a further angle lever having a lever arm receiving said guide.

* * * * *